US008096830B2

(12) United States Patent
Rodrigues

(10) Patent No.: US 8,096,830 B2
(45) Date of Patent: Jan. 17, 2012

(54) CONNECTOR WITH DEFORMABLE COMPRESSION SLEEVE

(75) Inventor: Julio Rodrigues, Collierville, TN (US)

(73) Assignee: Belden Inc., St. Louis, MO (US)

( * ) Notice: Subject to any disclaimer, the term of this patent is extended or adjusted under 35 U.S.C. 154(b) by 268 days.

(21) Appl. No.: 12/387,830

(22) Filed: May 8, 2009

(65) Prior Publication Data

US 2009/0280668 A1 Nov. 12, 2009

Related U.S. Application Data

(60) Provisional application No. 61/126,916, filed on May 8, 2008.

(51) Int. Cl.
*H01R 9/05* (2006.01)

(52) U.S. Cl. ..... 439/584

(58) Field of Classification Search ..... 439/583–585, 439/581, 578

See application file for complete search history.

(56) References Cited

U.S. PATENT DOCUMENTS

| | | | | |
|---|---|---|---|---|
| 2,691,059 | A | 10/1954 | Umina | |
| 3,171,707 | A | 3/1965 | Powell | |
| 3,184,706 | A | 5/1965 | Atkins | |
| 3,375,485 | A | 3/1968 | Donohue et al. | |
| 3,581,269 | A | 5/1971 | Frey et al. | |
| 3,744,011 | A | 7/1973 | Blanchenot | |
| 4,093,335 | A | 6/1978 | Schwartz et al. | |
| 4,456,323 | A | 6/1984 | Pitcher et al. | |
| 4,614,390 | A * | 9/1986 | Baker | 439/592 |
| 4,717,355 | A | 1/1988 | Mattis | |
| 4,834,676 | A | 5/1989 | Tackett | |
| 5,295,864 | A | 3/1994 | Birch et al. | |
| 5,466,173 | A | 11/1995 | Down | |
| 5,470,257 | A | 11/1995 | Szegda | |
| 5,501,616 | A | 3/1996 | Holliday | |
| 5,632,651 | A | 5/1997 | Szegda | |
| 5,888,094 | A | 3/1999 | Kubota et al. | |
| 5,993,254 | A | 11/1999 | Pitschi et al. | |
| 5,997,350 | A * | 12/1999 | Burris et al. | 439/585 |
| 6,089,912 | A * | 7/2000 | Tallis et al. | 439/584 |
| 6,322,390 | B1 | 11/2001 | Takeuchi | |
| 6,478,618 | B2 | 11/2002 | Wong | |
| 6,530,807 | B2 | 3/2003 | Rodrigues et al. | |
| 6,767,249 | B1 | 7/2004 | Li | |
| 6,793,529 | B1 | 9/2004 | Buenz | |
| 6,893,290 | B2 | 5/2005 | Buenz et al. | |
| 6,994,588 | B2 | 2/2006 | Montena | |
| 7,029,326 | B2 | 4/2006 | Montena | |
| 7,048,579 | B2 | 5/2006 | Montena | |
| 7,118,416 | B2 | 10/2006 | Montena et al. | |
| 7,128,603 | B2 | 10/2006 | Burris et al. | |
| 7,131,868 | B2 | 11/2006 | Montena | |
| 7,297,023 | B2 * | 11/2007 | Chawgo | 439/578 |
| 7,364,462 | B2 * | 4/2008 | Holland | 439/584 |

(Continued)

*Primary Examiner* — Xuong Chung Trans
(74) *Attorney, Agent, or Firm* — Foley & Lardner LLP

(57) ABSTRACT

A connector for a coaxial cable that includes a connector body and a deformable sleeve. The deformable sleeve and the connector body have cooperative structure for engaging the deformable sleeve with the receiving end of the connector body for securing a cable in the connector body. The deformable sleeve has a front section connected to a rear section by a web. The deformable sleeve is movable from a first position, wherein the front end of the deformable sleeve is separably attached to the receiving end of the connector, to a second position, wherein the cable is compressively secured in the connector body. The web stretches and/or breaks when the deformable sleeve moves into the second position.

23 Claims, 5 Drawing Sheets

U.S. PATENT DOCUMENTS 7,371,112 B2 5/2008 Burris et al.
7,452,237 B1 11/2008 Montena
7,455,549 B2 * 11/2008 Rodrigues et al. ..... 439/578
7,566,236 B2 * 7/2009 Malloy et al. ..... 439/321
7,568,945 B2 8/2009 Chee et al.

* cited by examiner

CONNECTOR WITH DEFORMABLE COMPRESSION SLEEVE

This application claims priority from provisional application Ser. No. 61/126,916, filed on May 8, 2008, which is incorporated herein in its entirety.

FIELD OF THE INVENTION

The present invention relates to electrical connectors and more particularly to axially compressible connectors that can accommodate cables having different diameters.

BACKGROUND OF THE INVENTION

Coaxial cables are high-frequency electrical transmission lines commonly used in the cable television industry to carry high-frequency or broadband signals, such as cable TV signals to television sets. Coaxial cables typically consist of a round conducting wire (also referred to herein as the "inner conductor" or "center conductor") surrounded by an insulating spacer or "dielectric" that may be solid or perforated with air spaces and may be covered with an aluminum foil. The insulating spacer is surrounded by a cylindrical conducting sheath (also referred to herein as the "outer conductor"), which is usually surrounded by a final (i.e., outer) insulating layer (referred to herein as the "jacket" or "sheath"). The jacket or sheath is typically made of a plastic material to insulate the cable and provide protection against corrosion and weathering. Coaxial cables are used as high-frequency transmission lines to carry a high-frequency or broadband signals. Because the electromagnetic field carrying the signal exists (ideally) only in the space between the inner and outer conductors, it cannot interfere with or suffer interference from external electromagnetic fields.

Coaxial cables are typically connected using RF (radio frequency) connectors, which are electrical connectors designed to work at radio frequencies in the multi-megahertz range. RF connectors are designed to maintain the shielding that the coaxial design offers. Higher quality versions also minimize the change in transmission line impedance at the connection. These connectors have a fastening mechanism (thread, bayonet, braces, push pull) and springs for a low ohmic electrical contact at a designed insertion force which allows multiple reconnects without reduced performance.

One type of connector used with coaxial cables includes a plastic sleeve that secures the cable in the connector. These connectors use a post barb to expand the cable and a plastic sleeve to secure the cable and provide both cable retention and a water tight seal around the cable jacket. This design works well for specific cable diameters that correspond to the inner diameter of the sleeve. However, if the inner diameter of the sleeve is increased so that the connector can also be used with cables having larger diameters, the cable retention level drops and the seal is lost when the connector is used with cables having smaller diameters. Therefore, there is a need for a coaxial cable connector with a sleeve that can accommodate cables of different diameters and still provide good cable retention and a good seal.

SUMMARY OF THE INVENTION

In accordance with the present invention, a connector for connecting a coaxial cable to a device is provided. The connector includes a connector body and a deformable sleeve. The connector body has a cable receiving end that is adapted to receive a coaxial cable and an opposed connection end that is adapted for connection to a device. The deformable sleeve includes an interior bore, a first (or front) end, a front section, a rear section, a second (or rear) end and a web. The front section extends between the first end and the web, the rear section extends between the web and the second end, and the web connects the front section and the rear section.

The deformable sleeve and the connector body have cooperative structure for engaging the deformable sleeve with the receiving end of the connector body for securing a cable in the connector body. The deformable sleeve is movable from a first position, wherein the front end of the deformable sleeve is separably attached to the receiving end of the connector, to a second position, wherein the cable is compressively secured in the connector body. The web stretches and/or breaks when the deformable sleeve moves into the second position. As used herein, the term "deformable sleeve" refers to a sleeve constructed of a material with elastic characteristics that changes shape when compressed and stretches and, when subjected to sufficient force, can break. Preferably, the deformable sleeve is formed from a semi-rigid plastic material with different wall thicknesses for the different sections of the sleeve. The web section has the thinnest wall so that when the sleeve is compressed along its longitudinal axis, the web stretches and/or breaks before the other sections of the sleeve.

The connector body can include a nut, a collar and a post. The nut has an interior bore, an interior surface, an extended first end that is preferably threaded and a second end having an inner surface, an outer surface and a plurality of flats on the outer surface. The extended first end of the nut forms the opposed connection end of the connector body. The interior bore of the nut can include a ledge extending inwardly from the interior surface (also referred to herein as "an internal ledge"), which limits the distance that the post can be inserted into the interior bore of the nut from the first end so that, when the collar is press fit onto the post, the nut is captured but can freely rotate. The internal ledge is located in the middle third of the nut, intermediate the first and second ends.

The collar includes a substantially cylindrical body having an interior bore with an inner diameter, an interior surface, a first end and a second end. The first end of the collar is adapted to receive the second end of the post and is press fit onto the post. This retains the nut between, and in close proximity to, the post and the collar while still allowing the nut to freely rotate. The internal ledge of the nut maintains the position of the nut in relation to the post and the collar. The second end of the collar is the cable receiving end of the connector body. The inner diameter for at least a portion of the interior bore of the collar decreases as the interior bore extends from the second end towards the first end. In addition, the inner diameter of the interior bore of the collar can decrease in stepped graduations as the interior bore extends from the second end towards the first end. A first stepped graduation is adapted to limit the insertion of the coaxial cable and a second stepped graduation is adapted to limit the insertion of the deformable sleeve into the collar.

The post includes an annular body having an interior bore, a first end with a flanged base and a second end. When the second end of the post is inserted into the first end of the nut, the flanged base passes into the nut until it contacts the internal ledge in the interior bore of the nut, which prevents the passage of the post all the way through the nut. The second end of the post is adapted to receive the coaxial cable. The post is secured in the connector body when the first end of the collar is press fit onto post. Preferably, the annular body of the post has a first section proximate the first end that extends to approximately the mid-point (i.e., about the middle third of the annular body between the first and second ends) and a second section proximate the second end that extends from the mid-point to the second end. The outside diameter of the first section of the post is greater than the outside diameter of the second section. The interior bore of the first end of the collar is designed so that it easily slips over the second section of the post and is then press fit onto the first section. Once the collar is press fit onto the first section of the post, it requires a substantial amount of force to separate the collar from the post.

The deformable sleeve is preferably formed from a plastic material and the front section, the rear section and the web each has a wall thickness. Preferably, the wall thickness of the web is less than the wall thicknesses of the front and rear sections. The front section of the deformable sleeve can include a funnel-shaped portion having a first end with a first outer diameter and a second end with a second outer diameter. The first outer diameter is greater than the second outer diameter and the second end is connected to the web. The application of a sufficient force to the second end of the deformable sleeve to insert the deformable sleeve into the collar can either stretch the web or separate the web from the second end of the funnel-shaped portion. When the deformable sleeve is compressed to secure the cable in the connector body, the inner diameter of the deformable sleeve is reduced. The deformable sleeve can also include a perimetrical lip on the first end, which is adapted to engage a circumferential ring extending from the interior surface of the collar and separably attach the first end of the deformable sleeve to the second end of the collar. After a cable is inserted into the connector, the deformable sleeve is forced into the collar and the perimetrical lip is disengaged from the circumferential ring and moves towards the first end of the collar. Preferably, the front section of the deformable sleeve has at least one circumferential rib extending radially from the outer surface. The circumferential rib acts in combination with the perimetrical lip to engage the circumferential ring and separably attach the deformable sleeve to the collar. As used herein, the term separably attached means that the deformable sleeve is attached to the collar but can easily be detached by the application of a sufficient force.

Preferably, the second end of the nut has an opening adapted to receive the first end of the collar. The first end of the collar fits snugly into the second end of the nut but does not prevent the nut from freely rotating after the collar is press fit onto the post. The connector can also include one or more O-rings for sealing the interior of the connector from the environment. One O-ring can be installed between the first end of the collar and the second end of the nut. Another O-ring can be installed between the second end of the collar and the rear section of the deformable sleeve.

When the connector is used to connect a coaxial cable, the coaxial cable is sequentially inserted in the second end of the deformable sleeve and the second end of the collar and received by the post. The second end of the collar is adapted to receive the first end of the deformable sleeve to compressively secure the coaxial cable in the connector. Depending on the size (i.e., the diameter) of the coaxial cable, the rear section of the deformable sleeve is forced over at least the front section of the deformable sleeve so that the front section compressively contacts the coaxial cable when the sleeve is compressed.

BRIEF DESCRIPTION OF THE FIGURES

The preferred embodiments of the connector with deformable sleeve of the present invention, as well as other objects, features and advantages of this invention, will be apparent from the accompanying drawings wherein.

DETAILED DESCRIPTION OF THE INVENTION

Figure 1:
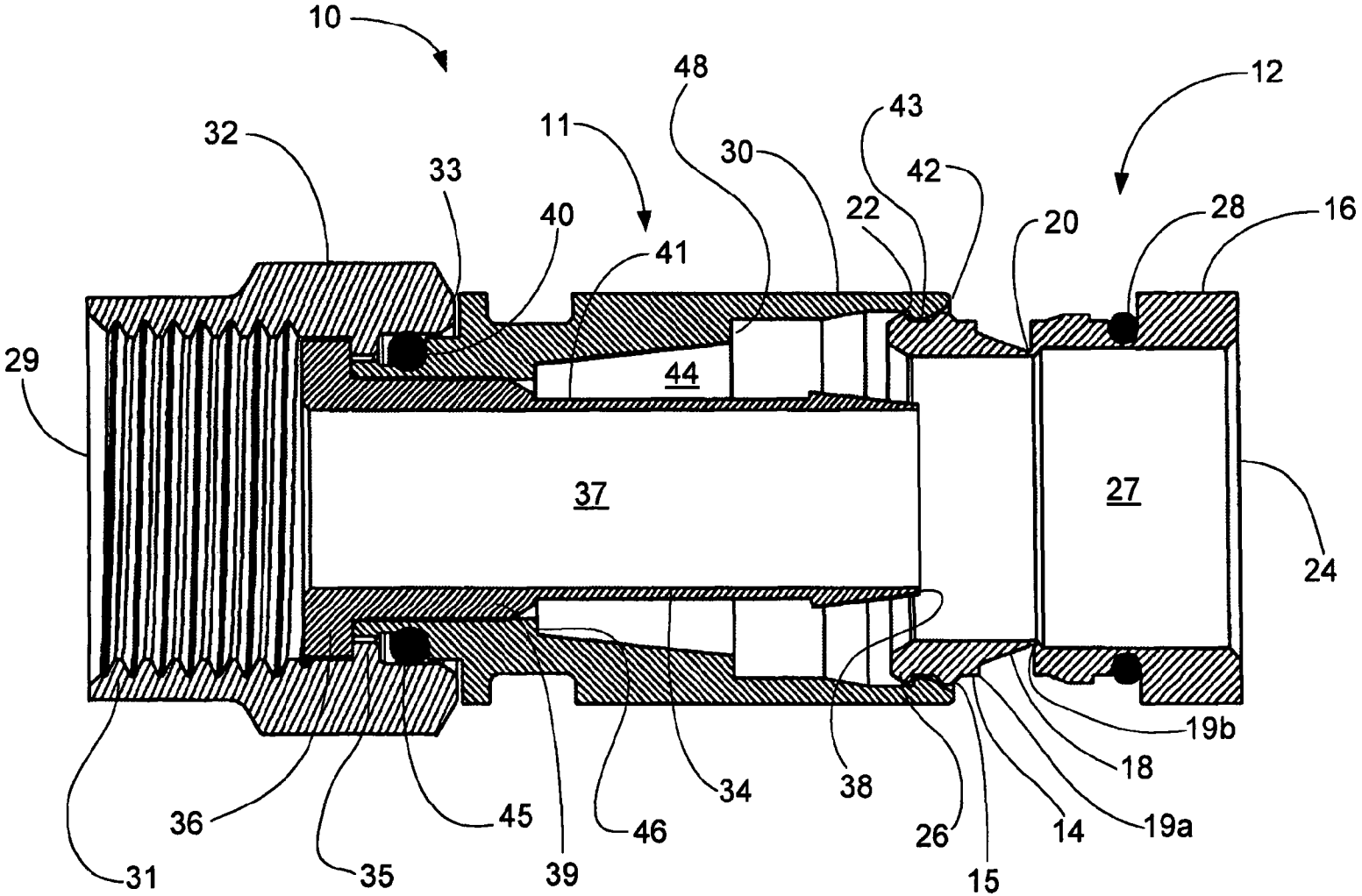
FIG. 1 is a side view of a preferred embodiment of the connector of the present invention with the cable connection end in the open position (i.e., before installation of a cable).

The present invention is a connector with a deformable sleeve that can accommodate cables having a variety of diameters. The connector is an improvement of the connector and locking sleeve disclosed in U.S. Pat. No. 6,530,807 to Rodrigues et al., which is incorporated herein in its entirety. In order to increase the range of cable diameters that the connector can accept, the deformable sleeve has two sections connected by a thin web that breaks or stretches when the deformable sleeve is compressed during installation of a coaxial cable in the connector. The deformable sleeve has an inner diameter that is large enough to allow easy insertion of the cable through the deformable sleeve and into the connector body. The cable is then secured in the connector by pushing the deformable sleeve into the connector body. The first end of the deformable sleeve passes into the connector body until it contacts a step (i.e., an abrupt change in the inner diameter) in the interior bore that prevents the sleeve from being inserted any further. The second section of the deformable sleeve is pushed over the top of the first section so that the first section of the deformable sleeve is wedged against the cable. As the second section of the deformable sleeve moves into the connector body, the web that connects the two sections of the deformable sleeve stretches and can break, depending on the diameter of the cable. For smaller diameter cables, the second section of the deformable sleeve slides further over the first section and breaks. For larger cables, the second section typically does not break because it does not have to move as far over the first section. Pushing the second section over the first section reduces the inner diameter of the first section of the deformable sleeve so that it tightly grips smaller diameter cables as well as cables having larger diameters.

The connector includes a nut, a post, a collar and a deformable sleeve and, optionally, one or more O-rings. Preferably, the nut, post and collar are made of an electrically conductive material, most preferably a metal such as copper, brass or aluminum. The nut can have an interior bore, an interior surface, an extended first end that preferably has a threaded interior surface and a second end with that preferably has a plurality of flats on the outer surface. The post can have an annular body with a flanged base on the first end and a plain or barbed second end for receiving a coaxial cable. In addition, the post can have a first section extending from the first end to about the mid-point and a second section extending from about the mid-point to the second end. As used herein, the term mid-point refers to the middle third of the annular body of the post along its longitudinal axis. The first section of the post has an outer diameter that is greater than the outer diameter of the second section. The collar has a substantially cylindrical body with an interior bore, a first end and a second end. In addition, the inner diameter of the interior bore of the collar decreases in the direction from the second end towards the first end and can also have stepped graduations for limiting the insertion of the outer cover of the coaxial cable and the deformable sleeve. The first end of the collar is adapted to receive the second end of the post and to be press fit onto the first section of the post. The second end of the collar is adapted to receive the sleeve. As used herein, the term "press fit" (also known as an "interference fit") is a fastening between two parts which is achieved by friction after the parts are pushed together, rather than by any other means of fastening. For metal parts in particular, the friction that holds the parts together is often greatly increased by compression of one part against the other, which relies on the tensile and compressive strengths of the materials that the parts are made from.

The deformable sleeve has an interior bore, through which the coaxial cable passes, and a front section at a first end and a rear section at a cable receiving second end that are connected to each other by a web. The front section can have a perimetrical lip on the first end with an outer diameter that is sized to engage a circumferential ring extending from the interior surface of the collar. The deformable sleeve can also have a circumferential rib next to the perimetrical lip that extends radially around the outer surface next to the perimetrical lip. Between the circumferential rib and the perimetrical lip is a groove, which receives the circumferential ring. Prior to installation of a coaxial cable, the perimetrical lip, either alone or in combination with the circumferential rib, engages the circumferential ring to separably attach the first end of the deformable sleeve to the second end of the collar. After a cable is inserted in the connector, the deformable sleeve is pushed into the collar and the perimetrical lip and circumferential rib separate from the circumferential ring. The perimetrical lip snugly contacts the inner surface of the collar as it is pushed into the collar.

The deformable sleeve is formed from an elastic material, such as plastic, and can be easily compressed by the application of sufficient pressure. The front section, the rear section and the web of the deformable sleeve each has a wall thickness. The wall thickness of the web is preferably less than the wall thicknesses of the front and rear sections so that, when the deformable sleeve is compressed along its longitudinal axis, the web stretches and/or breaks before the front or rear sections. The rear section of the deformable sleeve preferably includes a intermediate rear section and a rigid section. The rigid section acts like a plunger when the deformable sleeve is pushed into the collar.

The deformable sleeve can also have a funnel-shaped portion that connects the web to the front section. The funnel-shaped portion has a first end with a first outer diameter and a second end with a second outer diameter, which is less than the first outer diameter and connects to the web. Preferably, the outer diameter of the front section gradually decreases between the perimetrical lip and the funnel-shaped portion and then decreases more rapidly in the funnel-shaped portion. As the front section of the deformable sleeve is inserted into the second end of the collar, it is pushed over the funnel-shaped portion, causing it to move radially inwardly and compress against the outer surface of the coaxial cable. The rear section of the deformable sleeve can have a substantially rigid ring at the cable receiving end connected to the web by an intermediate rear section. When the rear section is forced into the second end of the collar, the intermediate rear section receives the funnel-shaped portion of the front section and pushes it radially inwardly against the coaxial cable.

Referring now to the drawings, FIG. 1 shows the connector 10 in the open position before a coaxial cable is installed. The connector 10 includes a connector body 11 and a deformable sleeve 12. The deformable sleeve 12 includes a front section 14 having a funnel-shaped portion 18, a rear section 16, a web 20, a first end 22, a second end (also referred to herein as cable receiving end) 24, a circumferential rib 15 on the outer surface, a lip 26 on the first end 22 and an interior bore 27 (see also FIG. 3). The funnel-shaped portion 18 has a larger diameter on the first end 19A and a smaller diameter on the second end 19B, which is connected to the first end of the web 20. The second end of the web 20 is connected to the rear section 16 of the deformable sleeve 12. An O-ring 28 is installed between the outer surface of the deformable sleeve 12 and the interior of the connector body 11 to seal the interior of the connector body 11 from dust and moisture.

The connector body 11 includes a collar 30, a nut 32 and a post 34. The nut 32 has an interior bore 29, a first end 31 that is internally threaded, a second end 33 with a connector and an internal ledge 35 that extends from the interior wall of the nut 32. The post 34 has a first end with a flanged base 36, an interior bore 37, a first section 39, a second section 41 and a second end 38. The first section 39 of the post 34 extends to about the mid-point of the post 34 and has a larger outer diameter than the second section 41. The second end 38 of the post 34 is inserted into the first end 31 of the nut 32 and passes through the nut 32 until the flanged base 36 contacts the internal ledge 35 of the nut 32. The second end 33 of the nut 32 receives the collar 30.

The collar 30 has a first end 40 that is received in the second end 33 of the nut 32 and a second end 42 that receives the deformable sleeve 12. The first end 40 of the collar 30 receives the second end 38 of the post 34, passes over the second section 41 of the post 34 and is press fit onto the first section 39 of the post 34. Press fitting the collar 30 onto the post 34 secures the nut 32 in place while allowing the nut 32 to freely rotate. An O-ring 45 can be installed between the outer surface of the first end 40 of the collar 30 and the interior surface of the second end 33 of the nut 32 to form a seal. The collar 30 also has an interior bore 44 that slopes inwardly so that the inner diameter decreases as the interior bore 44 extends from the second end 42 towards the first end 40. The interior bore 44 has first and second stepped graduations (also referred to as steps) 46, 48, which limit how far the cable jacket 52/outer conductor 58 and the deformable sleeve 12, respectively, can be inserted into the collar 30 (FIG. 2).

FIG. 1 also shows that the interior bore 44 of the collar 30 has a circumferential ring 43 extending inwardly near the second end 42. The first end 22 (also referred to herein as front end) (FIG. 3) of the deformable sleeve 12 is inserted into the second end 42 of the collar 30 prior to installation of a cable. The circumferential ring 43 engages the perimetrical lip 26 and circumferential rib 15 of the deformable sleeve 12 to separably attach the deformable sleeve 12 to the collar 30.

Figure 2:
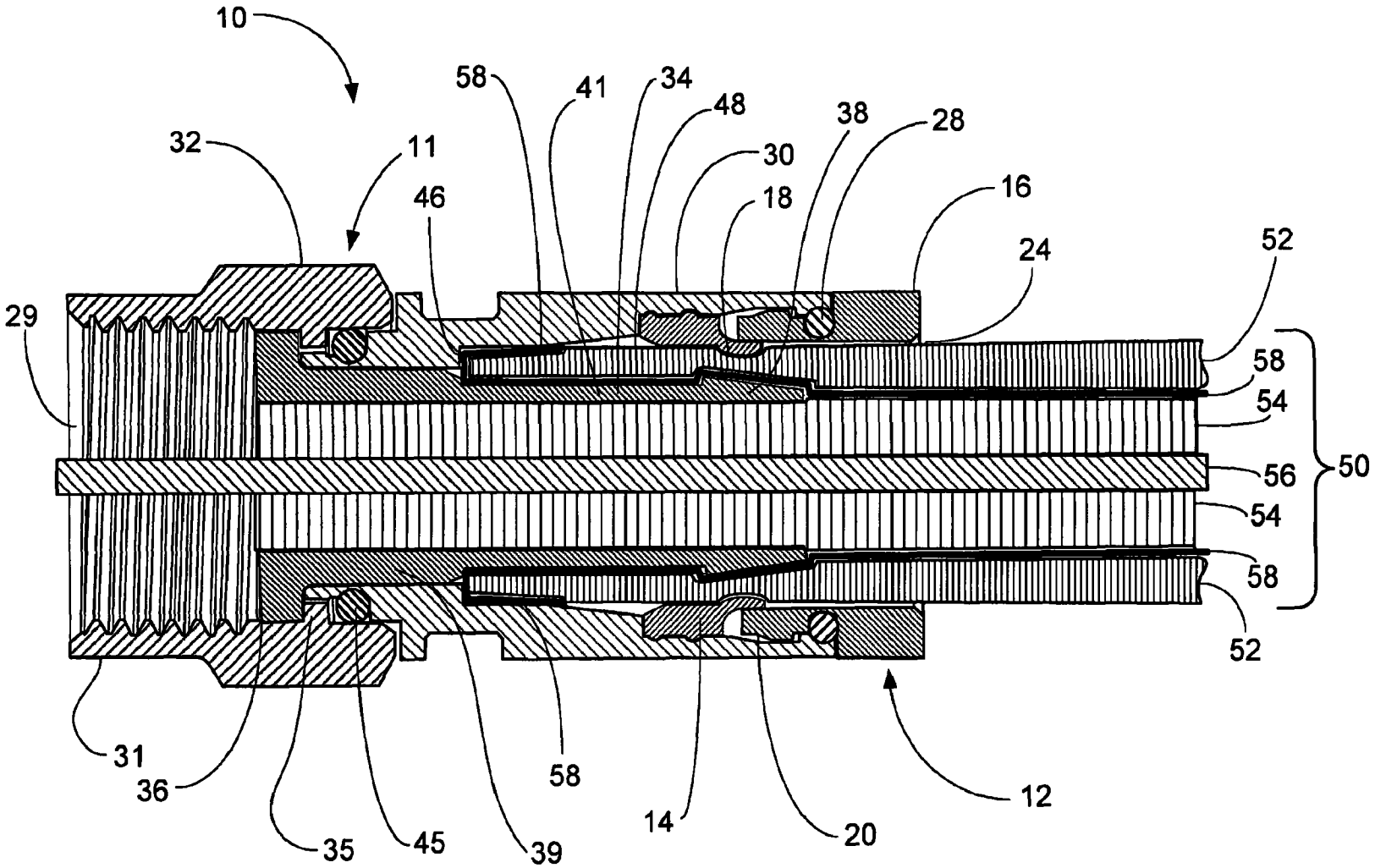
FIG. 2 is a side view of the connector in FIG. 1 after it is installed on a coaxial cable.

FIG. 2 shows the connector 10 after it is installed on a coaxial cable 50. The coaxial cable 50 is prepared in a conventional manner with the cable jacket 52 removed to expose a portion of the outer conductor 58, which is folded back over the cable jacket 52. This uncovers a section of the foil covered insulated portion 54, which is then partly removed to expose the center conductor 56. When the coaxial cable 50 is installed, the center conductor 56 and the foil covered insulated portion 54 are received in the second end 38 of the post 34 and the cable jacket 52 and the outer conductor 58 of the cable 50 pass over the outside of the post 34 so that the outer conductor 58 electrically contacts the outer surface of the post 34 and the interior surface of the collar 30. The cable 50 is pushed into the collar 30 until the first stepped graduation 46 limits how far the cable 50 can be inserted. The center conductor 56 extends to about the first end 31 of the nut 32 and is received in a connecting device (not shown) in a conventional manner when the first end 31 of the nut 32 is connected to the device.

The coaxial cable 50 is secured in the connector 10 by exerting an axial force on the deformable sleeve 12 to push the sleeve 12 into the second end 42 of the collar 30, preferably by using an installation tool (not shown). This deformable sleeve 12 is pushed into the collar 30 until the front end 22 of the deformable sleeve 12 contacts the second stepped graduation 48 in the collar 30. The rear section 16 of the deformable sleeve 12 receives the funnel-shaped portion 18 of the front section 14 and forces the front section 14 against the outside of the cable jacket 52, causing the thin web 20 that connects the two sections 14, 16 to stretch and/or break. The funnel-shaped portion 18 of the front section 14 is wedged under the rear section 16 and moves radially inwardly to grip the cable jacket 52 and secure the cable 50 in the connector 10.

Figure 3:
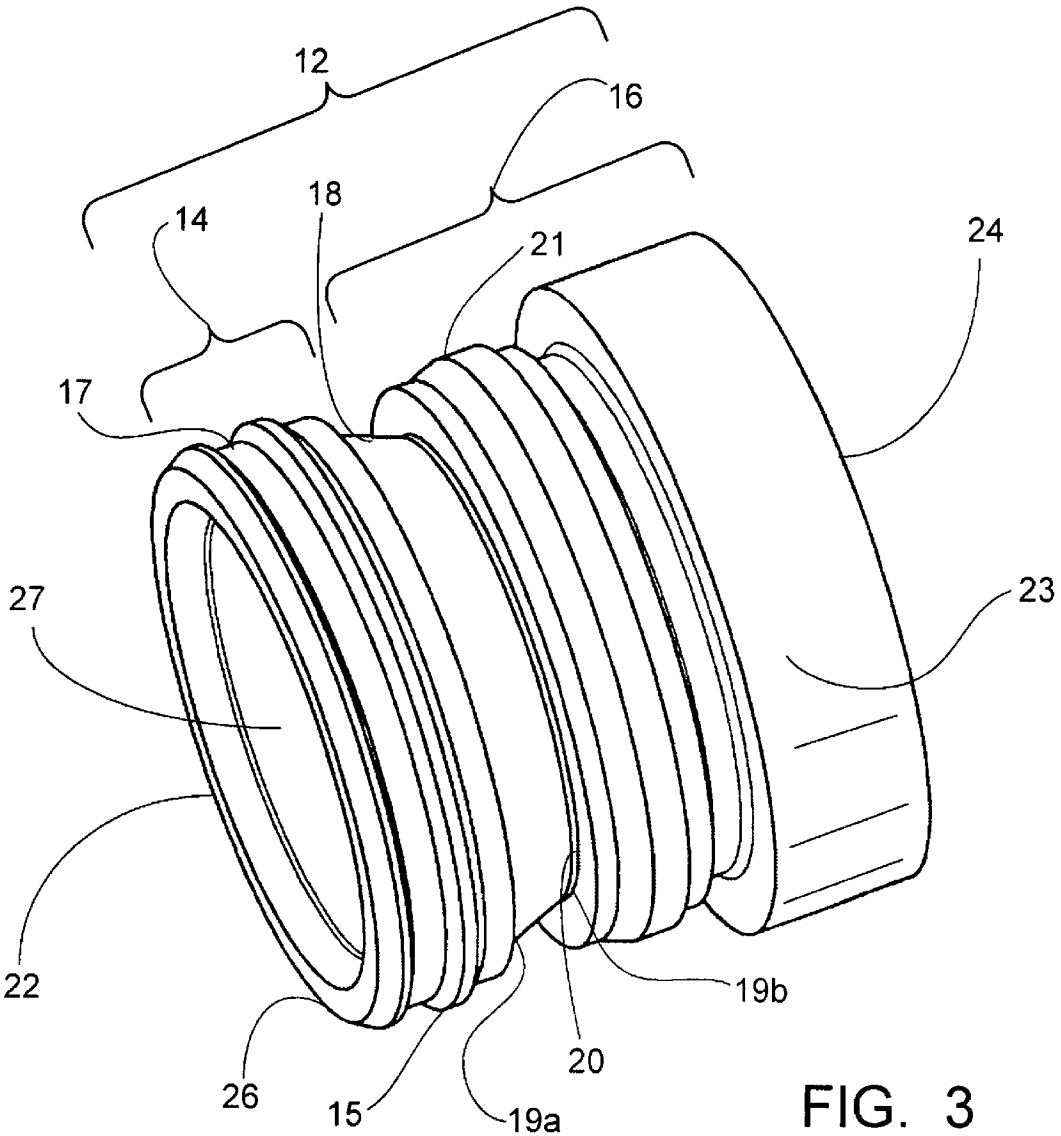
FIG. 3 is a perspective view of a preferred embodiment of the deformable sleeve of the present invention.

FIG. 3 shows the deformable sleeve 12 with a front section 14 having a first end 22 and a rear section 16 having a cable receiving end 24. The front section 14 is connected to the rear section 16 by a web 20. The front section 14 has a perimetrical lip 26 at the front end 22 and a funnel-shaped portion 18 at the opposing end that connects to the web 20. The front section 14 has a circumferential rib 15 next to the perimetrical lip 26 that forms a groove 17 therebetween for receiving the circumferential ring 43 of the collar 30 and separably attaching the deformable sleeve 12 to the collar 30. The rear section 16 of the deformable sleeve 12 has an intermediate section 21 that connects to the web 20 on one end and to a rigid section 23 on the other end. The rigid section 23 is at the second end of the deformable sleeve 12 and it is used to force the sleeve 12 into the collar 30. An O-ring 28 can be installed between the intermediate section 21 and the rigid section 23 to provide a seal.

The web 20 is preferably formed by a thin plastic material that easily stretches. When the deformable sleeve 12 is used to install a coaxial cable 50 in a connector 10, the web 20 of the deformable sleeve 12 either stretches or breaks so that the intermediate section 21 is forced over the funnel-shaped portion 18 and secures the cable 50 in the connector 10. The design of the funnel-shaped portion 18 allows the deformable sleeve 12 to be used with cables having different diameters. How far the rear section 16 of the deformable sleeve 12 is pushed into the connector 30 depends on the diameter of the cable. For smaller cables, the rear section 16 of the deformable sleeve 12 is pushed in further and the web 20 stretches or breaks to allow the funnel-shaped portion 18 to slide between the intermediate section 21 and the cable 50. When the deformable sleeve 12 is fully inserted in the collar 30, the intermediate section 21 of the deformable sleeve 12 is wedged between the interior wall of the collar 30 and the funnel-shaped portion 18 to compressively secure the funnel-shaped portion 18 against the cable 50 (FIG. 2).

Figure 4:
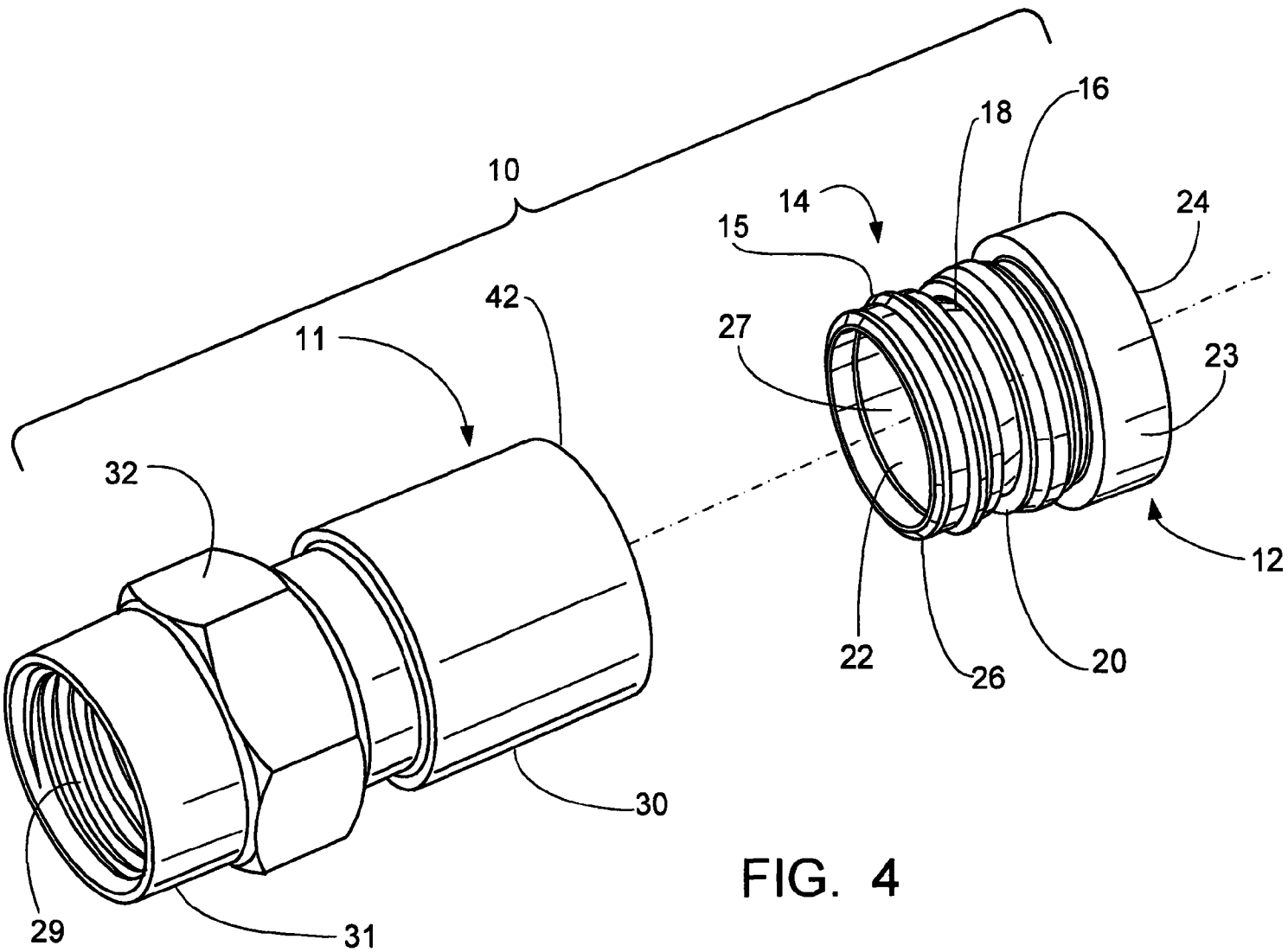
FIG. 4 is a perspective view of a preferred embodiment of the connector of the present invention showing the deformable sleeve before it is inserted into the connector body.
Figure 5:
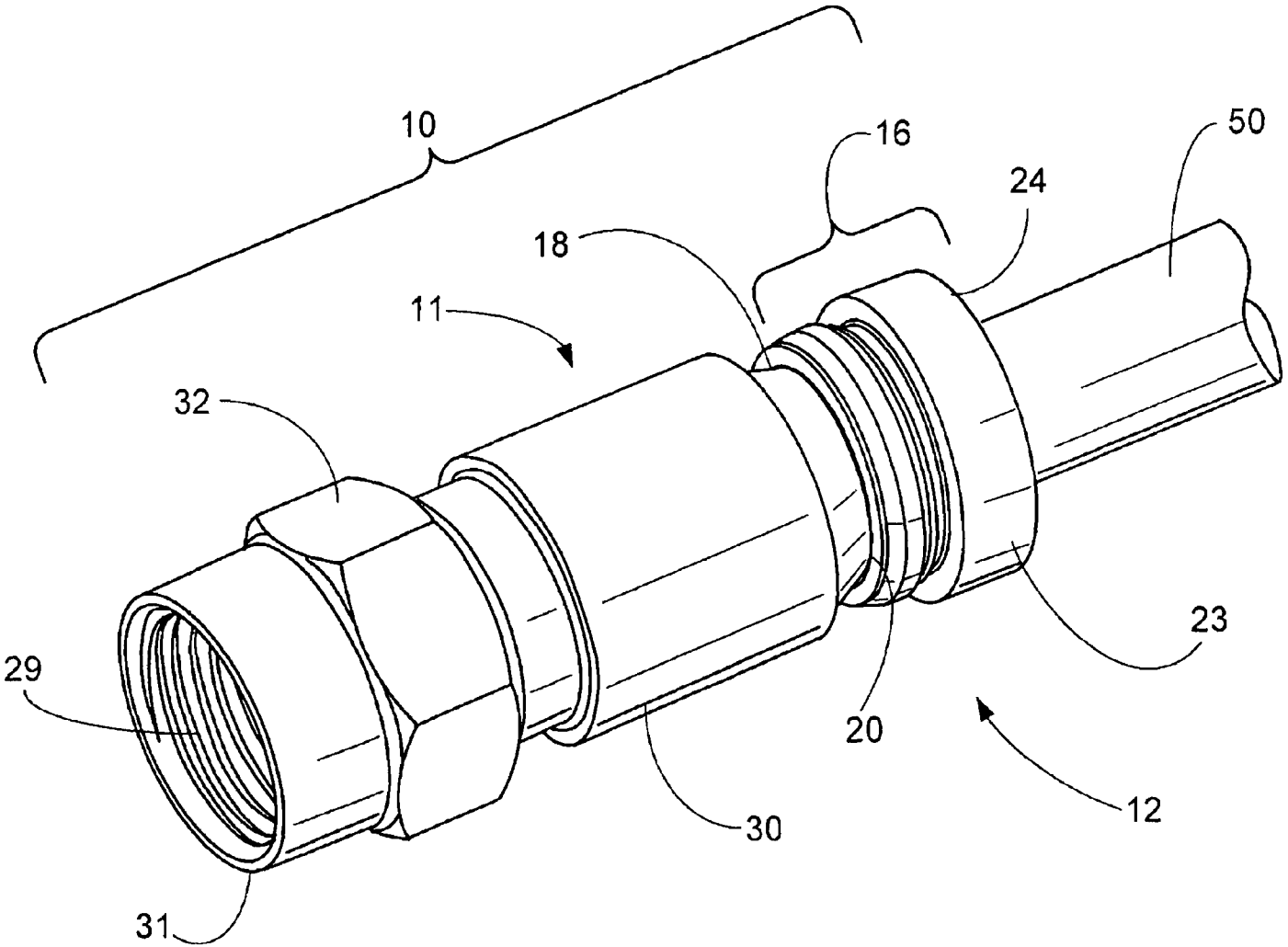
FIG. 5 is a perspective view of the connector shown in FIG. 4 with the deformable sleeve partially inserted into the connector body.

FIG. 4 shows the deformable sleeve 12 before it is installed in the second end 42 of the collar 30. The funnel-shaped portion 18 of the sleeve 12 facilitates the front section 14 being received by the rear section 16 as the sleeve 12 is forced into the collar 30. FIG. 5 shows the deformable sleeve 12 positioned in the connector 10 with a coaxial cable 50 inserted into the connector 10 through the deformable sleeve 12. After the cable 50 is fully inserted in the connector 10, the rear section 16 of the deformable sleeve 12 is pushed into the collar 30 to secure the cable 50 in the connector 10 (see also FIG. 2).

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. A connector for a coaxial cable comprising:

a connector body having a cable receiving end and an opposed connection end; and a deformable sleeve having an interior bore, a front end and a front section connected to a rear section by a web;

wherein the deformable sleeve and the connector body have cooperative structure for engaging the deformable sleeve with the receiving end of the connector body for securing a cable in the connector body;

wherein the deformable sleeve is movable from a first position, wherein the front end of the deformable sleeve is separably attached to the receiving end of the connector, to a second position, wherein the cable is compressively secured in the connector body; and wherein the web deforms such that a portion of the rear section slides forward of at least a portion of the front section when the deformable sleeve moves into the second position.

2. The connector for a coaxial cable according to claim 1, wherein the connector body comprises:

a nut comprising an interior bore, an interior surface, an extended first end and a second end, wherein the extended first end is the opposed connection end of the connector;

a collar comprising a substantially cylindrical body having an interior bore, an interior surface, a first end and a second end, wherein the second end is the cable receiving end of the connector; and a post comprising an annular body having an interior bore, a first end and a second end adapted to receive the cable, wherein the second end of the post is inserted into the first end of the nut, and wherein the post is secured in the connector body when the first end of the collar receives the second end of the post and is press fit onto the post.

3. The connector for a coaxial cable according to claim 2, wherein the nut has an internal ledge extending from the interior surface and the first end of the post has a flanged base, and wherein the internal ledge is adapted to contact the flanged base.

4. The connector for a coaxial cable according to claim 1, wherein the deformable sleeve is formed from a plastic material and the front section, the rear section and the web each has a wall thickness, and wherein the wall thickness of the web is less than the wall thicknesses of the front and rear sections.

5. The connector for a coaxial cable according to claim 1, wherein the front section of the deformable sleeve comprises a funnel-shaped portion having a first end with a first outer diameter and a second end with a second outer diameter, wherein the first outer diameter is greater than the second outer diameter, and wherein the second end is connected to the web.

6. The connector for a coaxial cable according to claim 1, wherein the deformable sleeve further comprises a perimetrical lip on the first end, and wherein the perimetrical lip is adapted to engage a circumferential ring extending from the interior surface of the collar and separably attach the first end of the deformable sleeve to the second end of the collar.

7. The connector for a coaxial cable according to claim 6, wherein the front section of the deformable sleeve has an outer surface, wherein a circumferential rib extends radially from the outer surface, and wherein the circumferential ring is engaged between the perimetrical lip and the circumferential rib.

8. The connector for a coaxial cable according to claim 1, further comprising an O-ring that is sealably installed between the first end of the collar and the second end of the nut.

9. The connector for a coaxial cable according to claim 1, wherein the deformable sleeve has an inner diameter, and wherein the inner diameter is reduced when the deformable sleeve secures the cable in the connector body.

10. The connector for a coaxial cable according to claim 1, wherein the interior bore of the collar has an inner diameter and wherein the inner diameter for at least a portion of the interior bore decreases as the interior bore extends from the second end towards the first end.

11. A connector for a coaxial cable comprising:

a nut comprising an interior bore, an interior surface, an extended first end and a second end;

a post comprising an annular body having an interior bore, a first end and a second end adapted to receive the coaxial cable;

a collar comprising a substantially cylindrical body having an interior bore, an interior surface, a first end and a second end, wherein the first end is press fit onto the post; and a deformable sleeve comprising an interior bore, a first end, a front section, a second end, a rear section and a web, wherein the front section extends between the first end and the web, the rear section extends between the web and the second end, and the web connects the front section and the rear section;

wherein the coaxial cable is sequentially inserted into the second end of the deformable sleeve and the second end of the collar and received by the post, and wherein the second end of the collar is adapted to receive the first end of the deformable sleeve to compressively secure the coaxial cable in the connector; and wherein the web is configured to deform such that the rear section extends forward of at least a portion of the front section to compressively secure the coaxial cable in the connector.

12. The connector for a coaxial cable according to claim 11, wherein the nut has an internal ledge extending from the interior surface and the first end of the post has a flanged base, and wherein the internal ledge is adapted to contact the flanged base of the post.

13. The connector for a coaxial cable according to claim 11, wherein the front section of the deformable sleeve is adapted to be received by the rear section of the deformable sleeve, and wherein at least the front section of the deformable sleeve compressively contacts the coaxial cable when the deformable sleeve is inserted into the second end of the collar.

14. The connector for a coaxial cable according to claim 11, wherein the deformable sleeve is formed from a plastic material and the front section, the rear section and the web each has a wall thickness, and wherein the wall thickness of the web is less than the wall thicknesses of the front and rear sections.

15. The connector for a coaxial cable according to claim 11, wherein the front section of the deformable sleeve comprises a funnel-shaped portion having a first end with a first outer diameter and a second end with a second outer diameter, wherein the first outer diameter is greater than the second outer diameter, and wherein the second end is connected to the web.

16. The connector for a coaxial cable according to claim 15, wherein the web separates from the second end of the funnel-shaped portion when a force is applied to the second end of the deformable sleeve to insert the deformable sleeve into the collar.

17. The connector for a coaxial cable according to claim 11, wherein the deformable sleeve further comprises a perimetrical lip on the first end and wherein the perimetrical lip is adapted to engage a circumferential ring extending from the interior surface of the collar and separably attach the first end of the deformable sleeve to the second end of the collar.

18. The connector for a coaxial cable according to claim 17, wherein the front section of the deformable sleeve has an outer surface, wherein a circumferential rib extends radially from the outer surface, and wherein the circumferential ring is engaged between the perimetrical lip and the circumferential rib.

19. The connector for a coaxial cable according to claim 11, further comprising an O-ring that is sealably installed between the first end of the collar and the second end of the nut.

20. The connector for a coaxial cable according to claim 11, further comprising an O-ring that is sealably installed between the second end of the collar and the deformable sleeve.

21. The connector for a coaxial cable according to claim 20, wherein the inner diameter of the interior bore of the collar comprises first and second stepped graduations, and wherein the first stepped graduation is adapted to limit the insertion of the coaxial cable into the collar and the second stepped graduation is adapted to limit the insertion of the deformable sleeve into the collar.

22. A connector for a coaxial cable comprising:

a nut comprising an interior bore, an interior surface, an extended first end, a second end and an internal ledge extending from the interior surface intermediate the first and second ends;

a post comprising an annular body having an interior bore, a first end having a flanged base and a second end adapted to receive the coaxial cable;

a collar comprising a substantially cylindrical body having an interior bore, an interior surface, a first end and a second end, wherein the first end is press fit onto the post; and a deformable sleeve comprising an interior bore, a first end, a front section, a second end, a rear section and a web, wherein the front section extends between the first end and the web, the rear section extends between the web and the second end, and the web connects the front section and the rear section, wherein the front section, the rear section and the web each has a wall thickness, and wherein the wall thickness of the web is less than the wall thicknesses of the front and rear sections;

wherein the coaxial cable is sequentially inserted into the second end of the deformable sleeve and the second end of the collar and received by the post, and wherein the second end of the collar is adapted to receive the first end of the deformable sleeve to compressively secure the coaxial cable in the connector; and wherein the web is configured to deform such that a portion of the rear section extends over a portion of the front section to compressively secure the coaxial cable in the connector.

23. The connector for a coaxial cable according to claim 22, wherein the annular body of the post has a first section with a first outer diameter proximate the first end and a second section with a second outer diameter proximate the second end, wherein the first outer diameter is greater than the second outer diameter, and wherein the first end of the collar is press fit onto the first section of the annular body.

* * * * *